United States Patent [19]

Franz

[11] Patent Number: 4,559,510

[45] Date of Patent: Dec. 17, 1985

[54] EQUIPMENT PROTECTING ELECTRICAL CIRCUIT BREAKER

[75] Inventor: Herbert Franz, Alzenau, Fed. Rep. of Germany

[73] Assignee: Heinrich Kopp GmbH & Co. KG., Kahl, Fed. Rep. of Germany

[21] Appl. No.: 595,568

[22] PCT Filed: Oct. 11, 1982

[86] PCT No.: PCT/EP82/00224

§ 371 Date: Mar. 2, 1984

§ 102(e) Date: Mar. 2, 1984

[87] PCT Pub. No.: WO84/01663

PCT Pub. Date: Apr. 26, 1984

[51] Int. Cl.[4] ..... H01H 75/00; H01H 75/12

[52] U.S. Cl. ..... 335/13; 335/35

[58] Field of Search ..... 335/13, 17, 23, 35, 335/201, 39, 41

[56] References Cited

U.S. PATENT DOCUMENTS

| | | | |
|---|---|---|---|
| 2,806,103 | 9/1957 | Gelzheiser . | |
| 3,256,407 | 6/1966 | Klein | 335/17 |
| 3,475,711 | 10/1969 | Stokes | 337/55 |

FOREIGN PATENT DOCUMENTS

| | | | |
|---|---|---|---|
| 2814070 | 4/1979 | Fed. Rep. of Germany | 335/13 |
| 3038511 | 6/1982 | Fed. Rep. of Germany . | |
| 2117785 | 7/1972 | France . | |

*Primary Examiner*—Harold Broome

*Attorney, Agent, or Firm*—W. G. Fasse; D. H. Kane, Jr.

[57] ABSTRACT

A compact equipment protecting electrical circuit breaker having a short-circuit and excess current tripping action as well as a signal change switch for actuating and protecting household appliances, office machines, manufacturing devices and the like, includes a breaker and tripping mechanism which is a combination of a cocking body (5) with an unlatching lever (4) supported therein, a tilting contact piece (6), and a cam lever (14) with the functional inclusion of several spring elements. The combination is mounted on a common axis in a central location below the operating mechanism (1–3) and between the hinged armature system (8) and a bimetal strip (10). The combination is further located or mounted above an arc quenching chamber (12) and above a signal change switch contact device (13) and above the various breaker terminals (15). The change switch has its own terminals for signalling the instantaneous operating condition of the circuit breaker.

10 Claims, 3 Drawing Figures

EQUIPMENT PROTECTING ELECTRICAL CIRCUIT BREAKER

BACKGROUND OF THE INVENTION

The invention relates to a single- or multi-pole compact circuit breaker of narrow construction for protecting equipment. Such circuit breaker constitutes an operating element of the equipment and is installed in a multiplicity of electrical apparatus and devices such as household applicances, office machines, control devices for manufacturing and assembling automats and the like. The circuit breaker acts as an on-off switch and protects the respective circuits and loads against short circuits and overloads, in addition to the simultaneous switch function. In most instances heretofore a separate fine-wire fuse or a melting fuse was provided for the protection separate from the on-off switch. Such fuse must be replaced after each defect and the replacement is costly and involved.

The present protection circuit breaker is comparable in its general construction and function to the known power line circuit breaker comprising a mechanical cocking drive for operating a breaker contact arrangement which may be switched on manually and which may be freely tripped either manually, electromagnetically, and electrothermally. The breaker contact arrangement is located in front of a spark quenching device. Such line protecting circuit breaker is, however, as a rule, continuously switched on and it is required that the circuit breaker can be switched on again after the removal of a fault following a short circuit or excess current tripping.

Contrary thereto, the equipment protecting electrical circuit breaker constitutes in its function a switch element which is frequently operated manually. Such switch element is additionally constructed to assume the above mentioned protection or monitoring functions so that the need for a separate safety fuse within the user current circuit may be obviated. Additionally, it is desirable to provide the equipment switch, or rather, the equipment protecting circuit breaker with a further contact arrangement as an auxiliary feature. Such a feature is supposed to provide an information of the respective switch or breaker condition in accordance with its switched on or switched off position within a separate signal or control current circuit. Thus, the auxiliary feature shall be able to indicate in a suitable manner the operational condition of the electrical appliance. The indication may, for example, be optical or acoustical. In the alternative or additionally the auxiliary feature may control other auxiliary units in accordance with the switch position or the switch condition of the circuit breaker.

In connection with the known power line circuit breakers or excess current protectors of the above mentioned type which are substantially larger, it is known to provide these excess current or line circuit breakers with an auxiliary switch as disclosed in German Patent Publication (DE-OS No. 3,038,511). In this connection such auxiliary feature, however, does not pose any special difficulties because the spacial arrangement of the switching and tripping mechanism in the upper portion of the conventional circuit breakers makes it generally possible to also install in this zone an auxiliary contact arrangement without any substantial modification. The contact arrangement is operated synchronously with the movable main contact of the breaker. The auxiliary contact arrangement has a smaller load rating and respectively it requires little space so that its installation is relatively easy.

On the other hand, substantial difficulties are encountered in connection with the equipment protecting circuit breaker disclosed herein if the additional accommodating of switching means, tripping members, and a quenching device is required in the space available inside the circuit breaker if its outer dimensions are not to deviate, or to deviate only insignificantly, from the installation dimensions of prior art on-off switches without such protective features. This fact explains why heretofore the constructor did not even consider providing an equipment protecting circuit breaker with a further contact arrangement.

OBJECTS OF THE INVENTION

In view of the above it is the aim of the invention to achieve the following objects singly or in combination:

to develop an equipment protecting circuit breaker in which the protecting device against short circuits and overloads may be installed in combination with a changing switch contact arrangement for signalling or control purposes;

to achieve such installation by a suitable construction and arrangement of all structural elements within the given dimensional range of a normal built-in switch construction; and to construct a protective circuit breaker as an equipment on-off switch in combination with a signalling switch.

SUMMARY OF THE INVENTION

These objects have been achieved according to the invention in an equipment protecting circuit breaker wherein the entire breaker mechanism comprises the combination of a cocking body having a plurality of functional projections, a V-shaped flat unlatching lever, a movable tilting contact piece and a single arm cam lever for the signal changing switch, wherein the entire breaker mechanism is tiltably supported on a common rotation axis in a central location in a housing or base, whereby the combination components cooperate in their function and wherein certain components are supported relative to each other and all components are supported relative to a housing by means of individual spring elements.

Due to this special construction and centralization of the breaker mechanism and due to its arrangement on a common rotational axis it is now possible to distribute the operating as well as the operated elements of the entire equipment protecting circuit breaker in a very limited space in the plane around such a breaker mechanism and to functionally couple these elements with the breaker mechanism.

Accordingly, the breaker mechanism comprises altogether four individual lever members tiltably supported on the same rotation axis in the breaker housing or on the base and it includes further three spring elements. Thus, the basic member is the cocking body made of insulating material on the frontside of which there are provided functional projections extending from its three corner points. The cocking body is rotated by a lever spring in the direction toward the off position. The lever spring is wound around a flange on the rear side of the cocking body. An unlatching lever, a movable tilting contact piece, and a cam lever for the signal changing switch are arranged in the space between the three functional projections of the cocking body. The unlatching lever and the movable tilting contact piece are made as stamped parts while the cam lever is made of synthetic material. Thus, the V-shaped flat unlatching lever cooperates through its bail shaped elongated pawl leg with the upper functional projection against which the unlatching lever bears additionally with a counter leg under the pressure of a pawl spring. The tilting contact member mounted on the cocking body is pressed by a spring causing the contact pressure, into the further reaching guide notch of the left functional projection. The contact causing spring is effective on the switching arm of the tilting contact piece and supports itself in front of the right functional projection. Thus, due to this guide play, the left functional projection is capable of being instantaneously effective on the switching arm when the circuit breaker is tripped. Additionally, a flexible cable conductor conductively connects one arm of a T-shaped extension of the tilting contact piece in the zone of its support.

This type of assembly has, compared to prior art cocking devices, the advantage that the unlatching lever and the movable tilting contact piece require a small spring excursion on the one hand while thereby assuring, on the other hand, a larger spring constant. Such advantages are achieved by the combined supporting and spring biasing of the unlatching lever and of the movable tilting contact piece by means of the corresponding pawl spring and pressure contact spring relative to the same movable cocking body of the breaker mechanism, as compared to prior art cocking devices in which the respective spring elements are individually supported relative to the housing.

A cam lever is loosely mounted on the rotation axis of these three lever members. The cam lever is provided for operating the contact arrangement of the signal changing switch in response to the switch-on or switch-off rotational movement of the cocking body. Thus, either the right functional projection or the left functional projection of the cocking body is effective on the central switch-over contact for tilting the central switch-over contact in one or the other switching direction. This overall arrangement of the breaker mechanism is then simply held in or on the breaker housing by means of a cover which is stuck on, whereby the cover slides in a form locking manner over the common rotational axis, thereby assuring the free movability of the breaker mechanism.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 3:
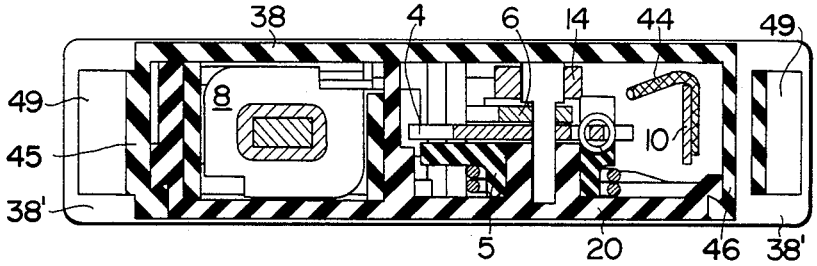
FIG. 3 shows a cross-section along section line 3—3 in FIG. 1 at the level of the rotational support of the circuit breaker mechanism.
Figure 2:
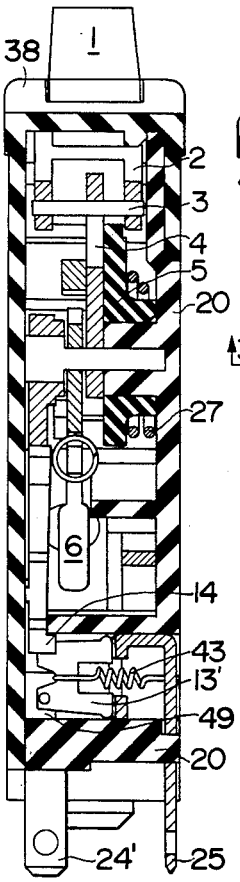
FIG. 2 shows a longitudinal section along section line 2—2 in FIG. 1 through the circuit breaker in the zone of its circuit breaker mechanism.
Figure 1:
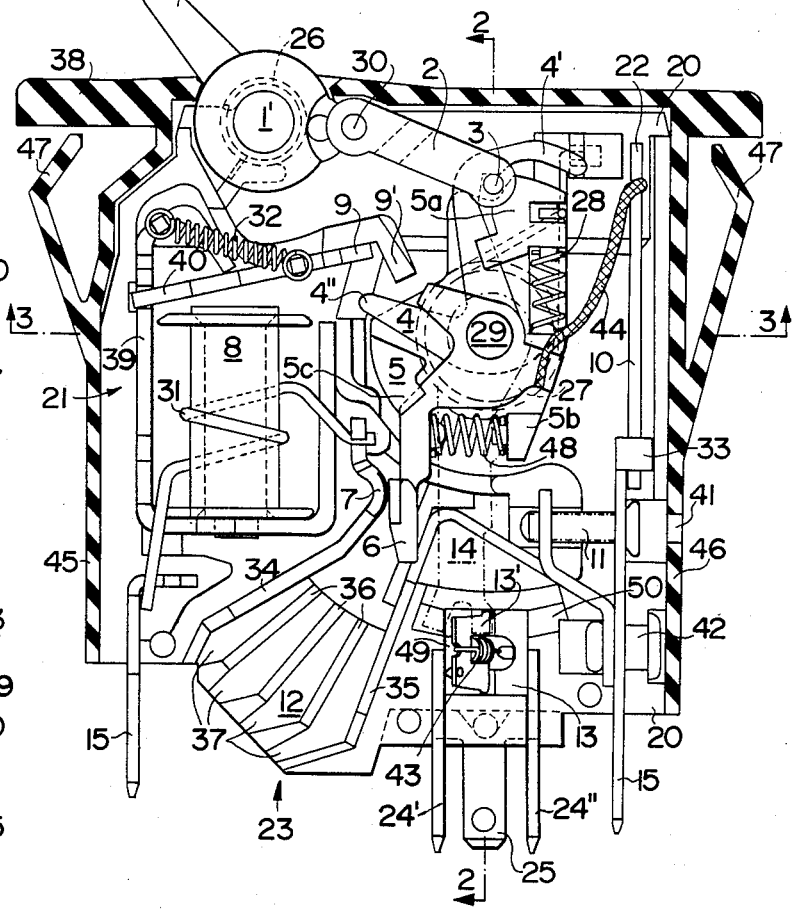
FIG. 1 shows the overall view of the circuit breaker in its switched-on, circuit closed position with the cover shown in section.

FIG. 1 is an enlarged view on a scale of 2.5:1 relative to the size of an actual embodiment. FIG. 1 shows that the circuit breaker mechanism is located approximately centrally in a housing or base 20 made of insulating material. The circuit breaker is flat as best seen in FIGS. 2 and 3. The circuit breaker mechanism is assembled to comprise several lever and spring members whereby the circuit breaker mechanism is located between an electromagnetic tripping device 21 arranged on the left side of the circuit breaker and an electrothermal tripping device 22 arranged on the right side of the circuit breaker. Further, the circuit breaker mechanism is located below an outwardly reaching operating toggle lever 1 as well as above a contact device 6, 7 and a quenching device 23 of the circuit breaker. The circuit breaker mechanism is further located above a contact arrangement of a signal changing switch having a movable center contact 13 connected to a first stationary center terminal 25, and movable for cooperation with one or the other of two stationary terminals 24' and 24''. Further terminals 15 form part of the circuit to be switched on or off and to be protected. The terminals 24', 24'' and 25 form part of the separate signalling circuit as will be described below.

Switching-on of the equipment protecting circuit breaker takes place with the aid of a knuckle or toggle joint coupling 30 through the connecting member 2 by counterclockwise tilting of the operating toggle 1 rotatable on a stud 1' against the force of its return spring 26. All movements of the connecting member 2 and of its crosswise extending pressure pin 3 are guided by a bail 4' of an unlatching lever 4. The connecting member 2 engages with its pin 3 an upper functional projection **5*a* of a cocking body 5 of the breaker mechanism. The projection 5*a* forms a guide slot for the bail 4'. When the cocking body 5 is moved in the opposite clockwise rotational direction against the force of its return spring 27 the unlatching lever 4 follows the pressure pin 3 under the effect of its pawl spring 28 the upper end of which bears against the projection 5*a*. The unlatching lever 4 and the cocking body 5 are supported on the same rotation axis 29. In the course of this clockwise motion, the pressure pin 3 is hooked under the bail shaped extension 4' of the unlatching lever 4, whereby the circuit breaker mechanism is in the cocked condition after the operating knuckle joint coupling 30 tilts over its dead point against the effect of the force of the leg spring 27 of the cocking body 5 and of the leg spring 26 of the operating toggle 1. Simultaneously, with the displacement of both pawl legs or extensions 4', 4'' of the unlatching lever 4 into their respective tripping position, the tilting contact piece 6 of the contact arrangement of the circuit breaker has been brought into conducting contact with the fixed contact 7. The tilting contact piece 6 is mounted for tilting with the cocking body 5 of the circuit breaker mechanism on the same rotation axis 29. Once engagement of the contacts 6 and 7 is established, a sufficient excess stroke in the rotational movement of the left functional projection 5*c* of the cocking body 5 makes sure that the required contact pressure is established by means of a coil spring 48 which is supported between the contact piece 6 and a right functional projection 5*b* of the cocking body 5. The left functional projection 5*c* of the cocking body 5** guides the contact piece 6 and moves the contact piece 6 for opening the contact 6, 7. The cocking body 5 is made of insulating material.

If now a short circuit current seven to ten times larger than the rated current, flows through the circuit breaker as the result of a defect, this short circuit current energizes the hinged armature system 8 through the turns of the winding 31 whereupon the magnetic armature 9 biased by a tension spring 32 is pulled down against the bias force of the spring 32 for releasing the entire circuit breaker mechanism by means of the leg 4'' of the unlatching lever 4 which is located opposite the magnetic armature 9. As a result, the other leg or bail shaped extension 4' of the unlatching lever 4 releases the operating elements which have been latched with the pressure pin 3 under its bail shaped extension 4'. Hence, the spring loaded operating toggle 1 snaps back clockwise into a starting position and so does the spring loaded circuit breaker mechanism by means of its cocking body 5 to assume its respective starting position in which the contacts 6, 7 are open. During this operation the two spring elements 26 and 27 are initially effective together on the cocking body 5 until the latter has completely opened the path between the contact pieces 6 and 7. When the contacts 6 and 7 are separated the cocking body 5 rests on a stop 9' provided in the housing 20. Thereafter, the leg spring 26 of the operating toggle 1 merely returns the latter into its starting position. The stop 9' also may function as a stop for the armature 9 when the spring 32 urges the armature 9 against the stop 9'.

Further, the excess stroke imparted to the cocking body 5 during the switching-on operation enables the lower functional projection 5*c* to become instantaneously, so to speak, effective on the arm of the contact piece 6 at the moment of a short circuit tripping to thereby cause a very rapid, as well as effective contact separation which, among others, prevents a contact welding.

On the other hand, if only a larger excess current flows through the circuit breaker due to a prolonged overloading of the utilization circuit being monitored, this condition becomes effective on the thermal tripping device 22 instead of an energization of the electromagnetic tripping device 21 with its armature system 8 forming a short circuit monitoring device. The thermal tripping device 22 includes a bimetal strip 10 connected electrically in series with the short circuit monitoring electromagnetic tripping device 21. In this situation the current of the connected utilization device flows through a resistor 33 which heats the bimetal strip 10 more or less, thereby causing the strip to respectively rapidly and strongly assume a bend directed inwardly of the circuit breaker. If this bent displacement is larger than the value which has been adjusted by means of an adjusting device 11 provided in the connection and mounting zone of the bimetal strip 10, then the strip 10 encounters with its free end the bail shaped extension 4' of the unlatching lever 4 and presses it out of the latching with the pressure pin 3 of the actuating elements and thus starts in the same manner the tripping operation which has been described for the short circuit condition. The free release feature provided for the circuit breaker mechanism makes sure in both instances that the circuit breaker cannot be switched on again as long as the cause for its tripping is present.

When the equipment protecting circuit breaker is switched off manually under load as well as when the breaker is tripped in response to a short circuit or an overload, an energy rich switching arc is formed across the contact interruption location formed by the contact pieces 6 and 7. Such arc is driven rapidly away from the points of its generation into an adjacent quenching chamber 12 of the arc quenching device 23 due to the V-shaped blowing loop formed by the arrangement of the tilting contact piece 6 with the fixed contact piece 7 and the connecting location of the latter. The arc thereby remains with one of its end points in continuous contact with a guide baffle 34 leading from the fixed contact piece 7 into the quenching chamber 12, whereas the spark over of the other end point is substantially facilitated by the extension of the oppositely arranged guide baffle 35 into the near zone of the tilting contact piece 6. Thereupon, the arc column is split up into partial arcs when it impinges on the facing ends of the three ferromagnetic quenching baffles 36 within the chamber 12. The split up arc is cooled between the baffles and deionized. Thereafter, the generated arc gases and the air cushion driven in front of the arc may escape safely and free of any rebound, into the environment through the venting slots 37 provided between the baffles and the housing wall.

The additional signal changing switch 13 of the equipment protecting circuit breaker has a tilting center contact 13' loaded or biased by a spring 43. The center contact 13' is brought mechanically into snap contact with one or the other of the fixed contact pieces 24', 24'' of the signal change switch 13. This is accomplished by the cam lever 14 in accordance with the switching-on or the switching-off or tripping movement of the cocking body 5. The cam lever 14 is supported on the same rotation axis 29 as the cocking body 5 of the circuit breaker mechanism. The unlatching lever 4 as well as with the tilting contact piece 6 are also supported on said axis 29. In this simple manner it is possible to switch other circuits in precise synchronism with the operational condition of the switched and simultaneously monitored electrical appliance, thereby requiring a minimum of space. For example, it is possible to optically signal the instantaneous circuit breaker position or the present operational condition. In the alternative it is possible to respectively control auxiliary devices in dependency on the circuit breaker position or the present operational condition.

The operation and further features of the present circuit breaker will now be described. The switching-on and the switching-off operation of the equipment protecting circuit breaker is accomplished with the aid of said operating toggle 1 extending out of the housing and through a cover 38 of the housing 20. The operating toggle 1 is tiltably supported on said axle stud 1' of the housing and its tilting takes place against the resetting force of said leg spring 26 operatively mounted to be effective between the stud 1' and the toggle 1. The operating toggle 1 is coupled with its inwardly reaching extension in the manner of a toggle joint 30 with the H-shaped coupling member 2 in the free end of which there is inserted the crosswise extending pressure pin 3. The pressure pin 3 is effective on the upper functional projection 5*a* of the cocking body 5 during the switching-on action, whereby the pressure pin 3 shifts the entire breaker mechanism beyond a dead point against the resetting force of the leg springs 26, 27 of the operating toggle 1 and of the cocking body 5. In this operation the unlatching lever 4 loaded by the compression spring 28 follows the cocking body 5. The unlatching lever 4 comprises on the inner side of the bail shaped extension of the respective unlatching lever arm a detent groove into which the pressure pin 3 may hook. Additionally, these elements enforce a guiding of the toggle joint connector member 2 in case of a free tripping as a result of which the operating toggle 1 should spring back. This feature saves a return spring for returning the pressure pin 3 into its latched position since a return spring would be necessary without this feature.

The electromagnetic tripping device 21, operating as a short circuit monitor for the circuit breaker, is constructed as a hinged armature system 8 which is mounted with its magnetic core and the exciter winding 31 enclosed in a U-manner by the magnetic yoke on the left narrow side of the housing 20, whereby it is inserted in a respective profiled housing section. Additionally, the armature 9 of the tripping mechanism is hinged at 40 to an extension of the outer magnet yoke leg from whence it is cocked by means of the tension spring 32. The hinged armature 9 reaches with its free end, which normally rests against the stop 9' when the winding 31 is not energized, into the functional zone of the neighboring circuit breaker mechanism in order to encounter the second pawl leg 4'' of the unlatching lever 4 when, due to a short circuit tripping of the circuit breaker the winding 31 is sufficiently energized to attract the armature 9 for moving the second pawl leg 4'' counterclockwise to thereby separate the contacts 6, 7. Due to this arrangement one achieves additionally a defined correlation of the hinged armature 9 relative to the magnetic yoke 39. Such correlation makes it unnecessary, as far as the precise dimensioning of the air gap between the magnet and the armature 9 is concerned, to provided for an adjustment thereof and it also makes any subsequent correction unnecessary.

The electrothermal tripping mechanism 22 of the circuit breaker comprises the bimetal strip 10 for protection against overloads. The electrothermal tripping mechanism is arranged adjacent to the breaker mechanism on the right hand narrow side of the housing 20.

The bimetal strip 10 comprises an adjustment device 11 above its insert mounting in a respective profiled section of the housing 20. The adjustment device 11 is accessible from the outside through a hole 41 in the cover 38 and serves for adjusting the precise thermal tripping point. The bimetal strip 10 extends downward to merge into one of the outer connector terminals 15. Additionally, the adjusting device 11 which is secured to the connector terminal 15, for example by welding, is constructed as a single piece together with the arc guide baffle 35 for the quenching device 23 further described below. On other side, the free operating end of the bimetal strip 10 is located opposite the bail shaped extension 4' of the pawl arm of the unlatching lever 4 of the circuit breaker mechanism, in order to start the tripping of the circuit breaker by a respective displacement due to an overload causing a bending of the bimetal strip 10. The contact interruption location formed by the fixed contact piece 7 and by the movable tilting contact piece 6 is arranged directly in front of the quenching chamber 12 for the resulting switching arc. The quenching chamber 12 in its turn extends in the space under the hinged armature system, whereby it fits into the lower portion of the circuit breaker housing 20 next to the signal changing switch 13. The quenching chamber 12 comprises two or more ferromagnetic quenching baffles 34, 35, 36 and is provided with the rearwardly extending gas exit slots 37. The quenching baffles are inserted in the longitudinal grooves of the housing 20 to extend approximately in parallel to one another. The outer baffles 34 and 35 are arc guide baffles located on both longitudinal sides of the inner quenching baffles 36. The arc guide baffles 34 and 35 extend all the way into the contact zone of the contact pieces 6, 7. One guide baffle 34 forms with its upper end the fixed contact piece 7 of the circuit breaker and simultaneously, the connection point for the end of the exciter winding 31 of the hinged armature system 8. The other guide baffle 35, as already mentioned, is constructed as a single piece with the adjustment device 11 for the bimetal strip 10 and is mechanically as well as electrically directly connected with the respective connection terminal 15 through a connector 42 such as a rivet or welding. It is further important that the contact pair 6, 7 is provided with layers of silver opposing silver cadmium oxide layers which assures a very low voltage drop and a high resistance against arcing and contact burning as well as an ability to prevent contact welding of the contact arrangement. The just stated advantages are further advantageously influenced at the time of tripping by the rapid separation of the contacts 6, 7 by the cocking body 5 of the circuit breaker mechanism. In its overall evaluation the embodiment disclosed herein achieves that the blow loop formed by the V-shape of the contact arrangements 6 and 7 itself drives the arc resulting from the opening of the circuit breaker very rapidly from the two contacts 6 and 7 along the guide baffles 34, 35 into the quenching chamber 12 wherein the arc is divided, cooled, and deionized by means of the baffles 36, whereupon the air cushion in front of the arc and the gases generated by the arc may escape into the environment without any danger through the gaps 37.

The signal changing switch 13 is arranged between the quenching chamber 12 and the connecting mounting member 42 for the bimetal strip 10. Incidentally, the bimetal strip 10 is electrically connected to the tilting contact piece 6 through a flexible conductor 44.

The signal changing switch 13 comprises the two fixed contact pieces 49 and 50 which are inserted into the housing bottom and which reach outwardly with their connecting terminals 24' and 24'' respectively. The tiltable center contact piece 13' is supported between the fixed contact pieces 49 and 50 on a projection of a further connecting terminal 25 reaching into the housing 20. The switch-over center contact piece 13' is biased by a spring 43 forming with the center contact piece a toggle device which is provided with an operating projection in addition to its double contact rivet. The operating projection is gripped in the manner of a fork by the cam lever 14 of the circuit breaker mechanism for tilting in accordance with the switching-on and switching-off operation or rather the tripping operation thereof, however, electrically independent of the switching and monitoring function of the equipment protecting circuit breaker as such. The tilting from one into the other switched position of the contact piece 13' takes place synchronously, in an auxiliary manner so to speak, to the monitoring function in order to signal the main operating condition that has been caused or is present in a suitable manner, for example by a buzzer or light, or to control other operations. The lever 14 is journalled on the axis 29 and operated by the projections **5*b* and 5*c* of the cocking body 5**.

With regard to the manufacturing and assembling features of the equipment protecting circuit breaker according to the invention, it is possible that the individual parts may be inserted and mounted in the housing 20 made of insulating material, either singly or as already preassembled combinations in a functional manner, whereby the housing is prepared and constructed for this purpose. The insertion may take place by hand or partially even by machine. Additionally, the assembled housing and its spacial shape is constructed as an insert which is provided with the cover 38 made of insulating material which closes the housing and reaches over both narrow sides of the housing as shown at 45 and 46. This cover 38 completely covers on the one side the mounting space of the circuit breaker, thereby functioning simultaneously as a safety against the loosening of the inserted parts and as a touch protection as well as a protection against contamination. On the other hand, it makes possible on the front side of the built-in type circuit breaker the unhindered access of the operating toggle 1 while leaving freely accessible at the underside thereof for the various connection terminals 15, 24', 24'' and 25. Finally, in the fully assembled position of the cover 38 on the housing 20, the cover 38 is elastically, but releasably hooked latched to the housing 20 by latching elements provided on the rear side of the housing 20 and on the cover 38. Such latching elements are conventional, e.g. a projection snapping into a hole. Further, the cover is provided on both of its outer narrow sides with spring tongues 47 formed as an integral part thereof. These spring tongues 47 cooperate with the front plate of the cover 38 to provide a releasable mounting of the circuit breaker in respective recesses 49 of an electrical appliance 38' or even in any other suitable location.

Incidentally, a spring 48 normally urges the cocking body 5 and the contact 6 in opposite directions while the spring 28 urges the cocking body 5 and the unlatching lever 4 in opposite directions.

Although the invention has been described with reference to specific example embodiments, it will be appreciated, that it is intended to cover all modifications and equivalents within the scope of the appended claims.

What is claimed is:

1. An equipment protecting compact electrical circuit breaker having a narrow thickness, comprising housing means, a breaker mechanism including circuit breaker contact means mounted in said housing means, a mechanical cockable drive for operating said breaker mechanism with its breaker contact means, said circuit breaker further comprising three separate release means including manual release means, electromagnetic release means, and electrothermal release means all operatively arranged for freely releasing said breaker mechanism, an arc quenching device, said breaker mechanism being located for cooperation with said arc quenching device for extinguishing a switching arc, and further including an integrated signal changing switch, a combination of components including:

(a) a cocking body (5) having a plurality of functional projections, (b) an unlatching lever (4), (c) a movable tilting contact piece (6), and (d) a cam lever (14) for actuating said signal changing switch in response to movement of said cocking body (5), said circuit breaker further comprising a common rotation axis for tiltably supporting said combination of components on said common rotation axis in said housing means, whereby said unlatching lever cooperates with a first functional projection of said functional projections of said cocking body and said tilting contact piece cooperates with a second functional projection of said functional projections, said circuit breaker further comprising first spring means arranged for biasing said cocking body in an off-position, second spring means for maintaining a spring bias between said unlatching lever and said first functional projection, and third spring means for maintaining a spring bias between said tilting contact piece and said second functional projection.

2. The equipment protecting circuit breaker of claim 1, wherein said manual release means comprise an operating toggle tiltably supported in said housing means, a reset spring for resetting said toggle, an H-shaped coupling member for loosely coupling said toggle to one of said functional projections of said cocking body for forming a toggle joint, said coupling member having a crosswise inserted pressure pin.

3. The equipment protecting circuit breaker of claim 1, wherein said manual release means comprise an operating toggle, and wherein said electromagnetic release means comprise a hinged armature system having a tilting armature, a tension spring biasing said tilting armature, said hinged armature system including a magnetic yoke and an extension projecting beyond said magnetic yoke into a release zone of an arm of said unlatching lever, said electromagnetic release means being arranged on a narrow side of said housing means adjacent to said breaker mechanism and below said operating toggle.

4. The equipment protecting circuit breaker of claim 1, wherein said electrothermal release means comprise a bimetal strip arranged on a narrow side of said housing means adjacent to said breaker mechanism, means rigidly and readjustably mounting one end of said bimetal strip in said housing means, said bimetal strip having a free operating end, said unlatching lever having another arm with a bail shaped extension, said free operating end of said bimetal strip being arranged opposite said bail shaped extension at the other arm of said unlatching lever.

5. The equipment protecting circuit breaker of claim 4, wherein said movable tilting contact piece includes a switching arm, said breaker mechanism further including flexible conductor means for electrically connecting said movable tilting contact piece to the free end of said bimetal strip, said circuit breaker contact means including a fixed contact piece, said electromagnetic release means comprising a hinged armature system and an exciter winding for said hinged armature system, said fixed contact piece being directly connected with one end of said exciter winding of said hinged armature system, said movable tilting contact piece and said fixed contact piece forming a V-shaped blowing loop when the circuit breaker is closing a circuit, said blowing loop becoming effective on a switching arc when the circuit breaker opens the circuit, said arc quenching device comprising an arc quenching chamber, said switching arc running from a circuit interruption location between said contact pieces into said arc quenching chamber.

6. The equipment protecting circuit breaker of claim 5, wherein said arc quenching chamber comprises a plurality of ferromagnetic quenching baffles arranged substantially in parallel to each other and supported in said housing means, said arc quenching chamber extending with a slant to below said hinged armature system, said arc quenching chamber having gas exit slots at its rear, said quenching baffles having two lateral baffles, one of which extends to form said fixed contact piece, while the other lateral baffle has an extension forming an electrically conducting connection with said mounting means for said one end of said bimetal strip.

7. The equipment protecting circuit breaker of claim 6, wherein said signal changing switch comprises connecting terminals and fixed contact members electrically connected to said terminals extending out of said housing means, said signal changing switch being located between said quenching chamber and said mounting means of said bimetal strip, said signal changing switch further comprising a switch-over contact member located between said fixed contact members, said switch-over contact member being constructed as a spring biased rocker member, said cocking body having a cam lever, whereby said rocker member is operable through said cam lever by the respective rotational movement of said cocking body of said breaker mechanism.

8. The equipment protecting circuit breaker of claim 1, wherein said electromagnetic release means comprise a hinged armature means comprising a current flow path within said circuit breaker, said current flow path comprising the following elements connected electrically in series, a first connector terminal, an exciter winding for said hinged armature means, a circuit interruption path formed by said movable tilting contact piece and a fixed contact piece directly in front of said arc quenching device, a bimetal strip or resistor, and a second connector terminal, and wherein said signal changing switch comprises two fixed contact terminals, a center contact and means for tilting said center contact in accordance with a respective breaker condition but electrically independently of the circuit of the circuit breaker, from one fixed contact terminal to the other fixed contact terminal.

9. The equipment protecting circuit breaker of claim 1, wherein said electromagnetic release means comprise a hinged armature system with its connecting terminal, said thermoelectric release means comprising a bimetal strip including connection and adjustment mounting means for electrothermally operating said breaker mechanism, said arc quenching device comprising guide and quenching baffles partially in connection with said adjustment mounting means, and wherein said signal changing switch comprises a contact arrangement with its connection terminals, all of the just enumerated components being mounted on or within said housing means constructed as an insert, said circuit breaker further comprising a cover made of insulating material for said housing insert, said cover fully covering a mounting side of said housing insert and reaching around both narrow sides of said housing insert, said manual release means further comprising an operating toggle for manually operating said breaker mechanism, said cover having an opening in its top side through which said operating toggle reaches and which cover holds, partially in a movable manner, said enumerated components and which cover also provides a touch protection for the circuit breaker.

10. The equipment protecting circuit breaker of claim 9, wherein said cover of insulating material, which is releasably engaging said housing insert at its backside, is provided at its two narrow sides with spring tongues formed as part of the cover for holding said circuit breaker in a respective equipment recess.

* * * * *